US008490715B2

(12) United States Patent
Engelfried et al.

(10) Patent No.: US 8,490,715 B2
(45) Date of Patent: Jul. 23, 2013

(54) HAND-HELD MACHINE TOOL

(75) Inventors: Uwe Engelfried, Ostfildern (DE); Andre Ullrich, Echterdingen (DE); Richard Engel, Sebnitz (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 155 days.

(21) Appl. No.: 12/529,188

(22) PCT Filed: Feb. 5, 2008

(86) PCT No.: PCT/EP2008/051408

§ 371 (c)(1),
(2), (4) Date: Dec. 11, 2009

(87) PCT Pub. No.: WO2008/107253

PCT Pub. Date: Sep. 12, 2008

(65) Prior Publication Data

US 2010/0108339 A1 May 6, 2010

(30) Foreign Application Priority Data

Mar. 2, 2007 (DE) ..... 10 2007 009 985

(51) Int. Cl.
*B25D 11/06* (2006.01)

(52) U.S. Cl.
USPC ..... 173/109; 173/104; 173/114; 173/90

(58) Field of Classification Search
USPC ..... 173/104, 109, 114, 90
See application file for complete search history.

(56) References Cited

U.S. PATENT DOCUMENTS

| | | | | |
|---|---|---|---|---|
| 4,719,976 | A * | 1/1988 | Bleicher et al. | 173/109 |
| 5,277,259 | A * | 1/1994 | Schmid et al. | 173/13 |
| 5,366,025 | A * | 11/1994 | Dutschk et al. | 173/109 |
| 5,435,397 | A * | 7/1995 | Demuth | 173/109 |
| 6,234,255 | B1 * | 5/2001 | Feldmann et al. | 173/114 |
| 6,460,627 | B1 * | 10/2002 | Below et al. | 173/48 |
| 7,051,820 | B2 * | 5/2006 | Stirm | 173/109 |
| 7,168,169 | B2 * | 1/2007 | Moreno | 30/394 |
| 7,174,969 | B2 * | 2/2007 | Droste | 173/48 |
| 7,395,872 | B2 * | 7/2008 | Duesselberg et al. | 173/48 |
| 7,404,451 | B2 * | 7/2008 | Neumann | 173/109 |
| 7,445,054 | B2 * | 11/2008 | Heep et al. | 173/48 |
| 7,591,324 | B2 * | 9/2009 | Saur | 173/48 |
| 2006/0266535 | A1 * | 11/2006 | Droste | 173/49 |

FOREIGN PATENT DOCUMENTS

| | | | |
|---|---|---|---|
| DE | 102005041447 | A1 | 3/2007 |
| EP | 0331619 | B1 * | 12/1992 |
| WO | WO 2006029916 | A1 * | 3/2006 |
| WO | 2006056513 | A1 | 6/2006 |

* cited by examiner

*Primary Examiner* — Brian D Nash
(74) *Attorney, Agent, or Firm* — Maginot, Moore & Beck

(57) ABSTRACT

The invention relates to a hand-held machine tool, in particular a hammer drill and/or chipping hammer. The tool according to the invention has a transmission device with a drive bearing that has at least one torque-transmitting means with a transmitting contour for transmitting a torque onto the drive bearing. According to the invention, the transmitting contour of the torque-transmitting means is produced by axial machining and/or a stamping and/or planning process.

7 Claims, 4 Drawing Sheets

HAND-HELD MACHINE TOOL

CROSS-REFERENCE TO RELATED APPLICATION

This application is a 35 USC 371 application of PCT/EP2008/051408 filed on Feb. 5, 2008.

BACKGROUND OF THE INVENTION

1. Field of the Invention

The invention is based on a hand-held power tool

2. Description of the Prior Art

There is already a known hand-held power tool that has a transmission device equipped with a drive end bearing. The drive end bearing has a torque transmitting element with a transmitting contour for transmitting a torque to the drive end bearing.

ADVANTAGES AND SUMMARY OF THE INVENTION

The invention is based on a hand-held power tool, in particular a rotary hammer and/or a hammer chisel, having a transmission device equipped with a drive end bearing that has at least one torque transmitting element with a transmitting contour for transmitting a torque to the drive end bearing.

According to one proposed embodiment, the transmitting contour of the torque transmitting element is manufactured by means of an axial machining and/or a stamping process and/or a milling process, advantageously making it possible to achieve an inexpensive manufacture with a particularly short manufacturing time for the transmitting contour of the torque transmitting element. In this connection, the expression "axial machining" is understood to mean a production process in which a machining occurs at least essentially, and advantageously exclusively, by means of a translatory relative movement in at least one axial direction between a component, in particular the torque transmitting element, and a tool; preferably no relative rotational movement or at least no significant relative rotational movement occurs between the torque transmitting element and the machining tool. The drive end bearing is preferably provided together with a wobble drive in order to convert a rotating motion of a shaft, e.g. an intermediate shaft, into an axial reciprocating motion in order to produce an axial hammering pulse.

According to another proposed embodiment, the torque transmitting element is of one piece with the drive end bearing, thus permitting savings of additional parts, space, assembly complexity, and costs. The expression "of one piece with" here is understood in particular to mean embodied of one piece and/or that the drive end bearing and the torque transmitting element comprise a single component that is produced from a single piece.

An advantageous torque transmission with a simultaneous support of the torque transmitting element on an axle or shaft such as an intermediate shaft of the transmission device, can be achieved if the transmitting contour is situated on a radially outward-oriented surface of the torque transmitting element. It is also conceivable, however, to situate the torque transmitting contour on a radially inward-oriented surface and/or on an end surface of the torque transmitting element.

According to another proposed embodiment of the invention, the transmitting contour has at least two transmitting elements that are situated spaced uniformly apart from each other in a circumference direction of the torque transmitting element, thus in particular enabling a uniform transmission of torque from another component to the torque transmitting element.

If the hand-held power tool also includes a transmission element on which the torque transmitting element is rotatably supported, then this enables achievement of an inexpensive, part-saving support on an already existing component, i.e. the transmission element, that is required for the function of the transmission device. The transmission element is preferably constituted by an axle and/or particularly advantageously, by a shaft such as an intermediate shaft.

According to an advantageous proposed modification, the torque transmitting element has at least one stamped relief groove, enabling a structurally simple manufacture to be achieved by means of a stamping process. In this connection, it is particularly advantageous if the stamped relief groove is situated on a side of the torque transmitting element oriented toward the drive end bearing.

BRIEF DESCRIPTION OF THE DRAWINGS

The invention will be better understood and further objects and advantages thereof will become more apparent from the ensuing detailed description of a preferred embodiment taken in conjunction with the drawings, in which.

DESCRIPTION OF THE PREFERRED EMBODIMENT

Figure 1:
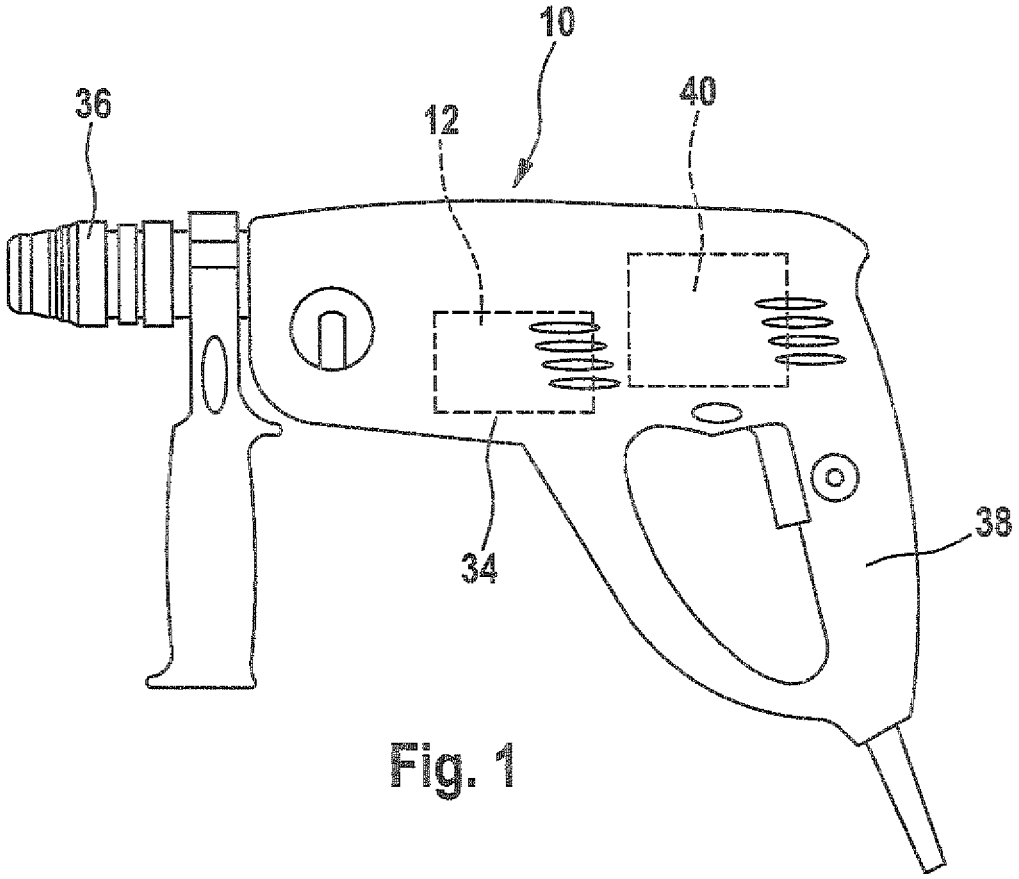
FIG. 1 is a side view of a hand-held power tool according to the invention, embodied in the form of a rotary hammer.

FIG. 1 shows a hand-held power tool 10 embodied in the form of a rotary hammer. The hand-held power tool 10 includes a housing 34 and, in a front region, a tool holder 36 for holding a tool. At an end oriented away from the front region, the hand-held power tool 10 has a main handle 38 for actuating the hand-held power tool 10 and for transmitting force from an operator to the hand-held power tool 10. The hand-held power tool 10 has a drive unit 40 comprised of an electric motor to produce a drive moment. The torque of the drive unit 40, in the form of a drive moment, is transmitted via a transmission device 12 of the hand-held power tool to a pneumatic impact mechanism 42, which is only partially shown for the sake of visibility, and/or to a rotating output element constituted by a hammer tube 44 (FIG. 2).

Figure 2:
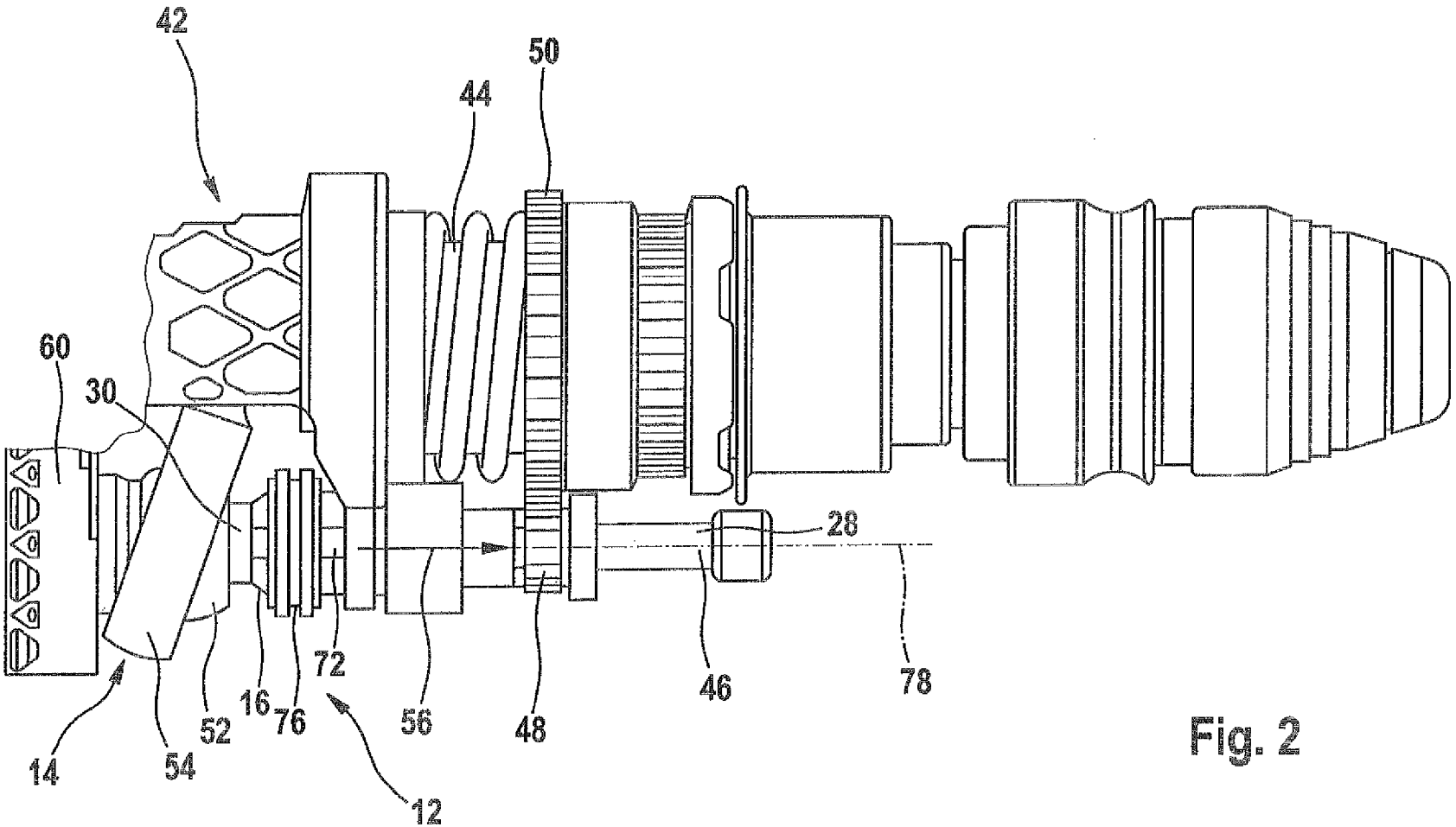
FIG. 2 is a side view of a transmission device of the hand-held power tool.

FIG. 2 shows a subregion of the handheld power tool 10 with the transmission device 12. The transmission device 12 has a transmission element 28 composed of an intermediate shaft 46 via which the torque of the drive unit 40 is transmitted to the impact mechanism 42 and the hammer tube 44 during operation of the hand-held power tool 10. To this end, a drive end bearing 14 and a gear unit 48 of the transmission device 12 are supported on the intermediate shaft 46. During operation of the hand-held power tool 10, the drive end bearing 14 converts a rotating motion of the intermediate shaft 46 into an axial motion to generate a hammering pulse and transmits this motion to the impact mechanism 42. The gear unit 48 serves to transmit the torque from the intermediate shaft 46 to the hammer tube 44 or more precisely, to a gear 50 that is coupled to the hammer tube for co-rotation.

Figure 3:
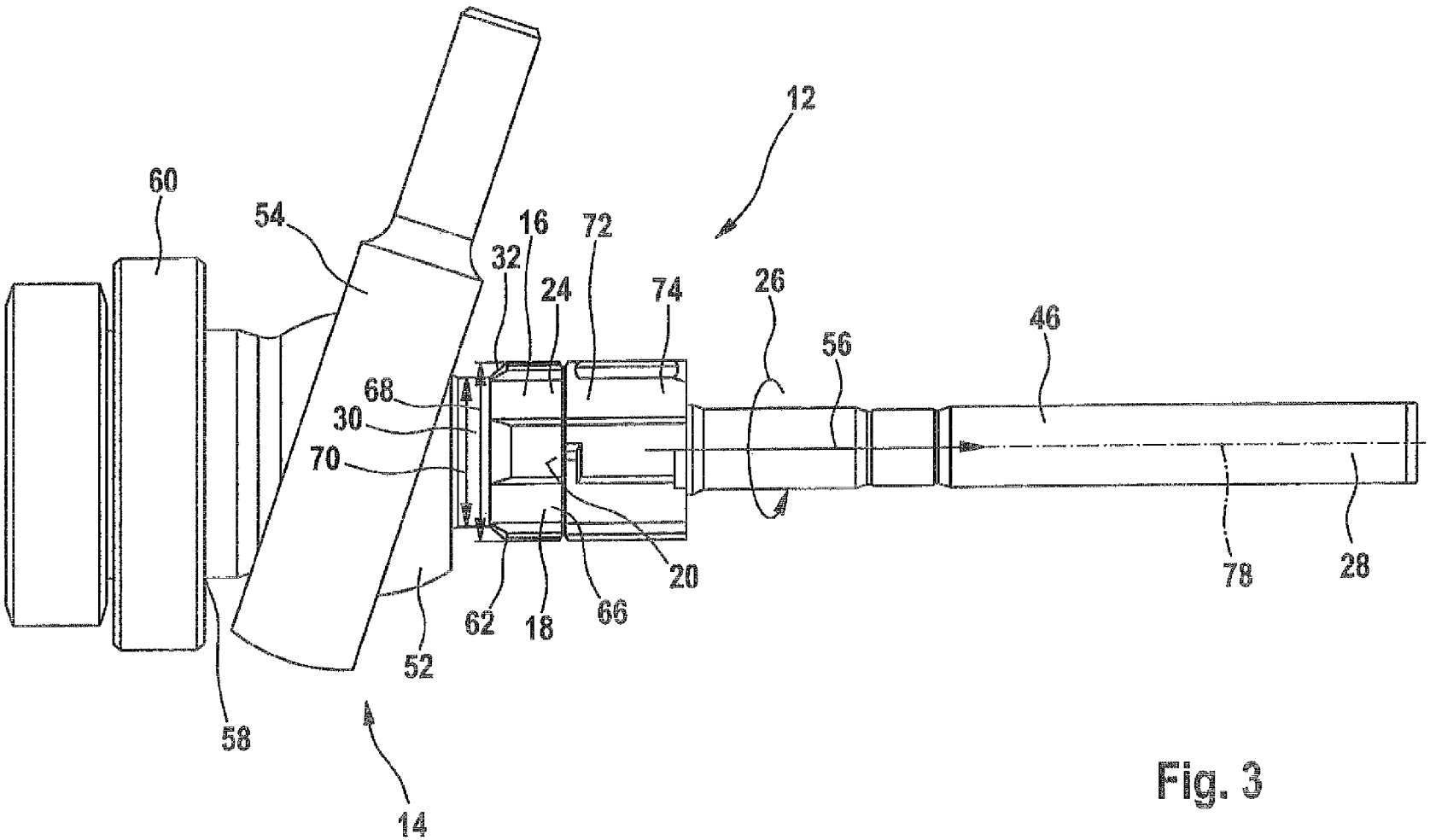
FIG. 3 is a side view of a drive end bearing of the transmission device.
Figure 4:
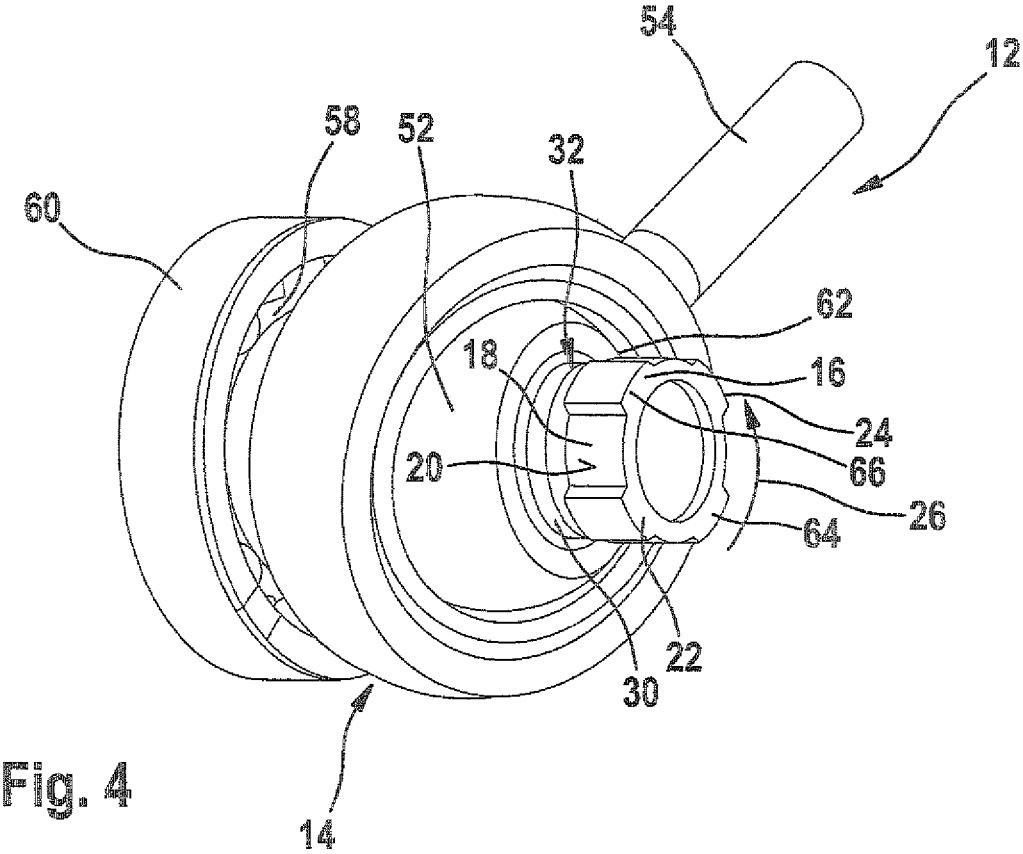
FIG. 4 is a perspective view of the drive end bearing from FIG. 3.

To permit a transmission of torque to the drive end bearing 14, the drive end bearing 14 has a torque transmitting element 16 with a transmitting contour 18. The drive end bearing 14 and the torque transmitting element 16 are embodied of one piece with each other and are rotatably supported on the intermediate shaft 46. The torque transmitting element 16 is situated along the force flow direction 56 of the intermediate shaft 46 at an output end 62 of the drive end bearing 14. The drive end bearing 14 also has a bearing sleeve 52 and a wobble pin 54, with the wobble pin 54 supported on the bearing sleeve 52. When the bearing sleeve 52 is rotated around a rotation axis 78 of the intermediate shaft 46, the wobble pin 54 executes a reciprocating motion along the force flow direction 56. The drive end bearing 14 is supported with its drive unit end 58 resting against an intermediate flange 60 of the hand-held power tool 10 (FIGS. 2 through 4).

The transmitting contour 18 of the torque transmitting element 16 has four transmitting elements 22, 24, 64, 66 that are situated on a radially outward-oriented surface 20 of the torque transmitting element 16. In addition, the four transmitting elements 22, 24, 64, 66 of the torque transmitting element 16 are situated spaced uniformly apart from one another in a circumference direction 26 constituted by a rotation direction of the torque transmitting element 16 (FIGS. 3 and 4). The transmitting contour 18 of the torque transmitting element 16 is manufactured by means of a stamping process with an axial machining. To this end, the torque transmitting element 16 has a stamped relief groove 30 on a side 32 oriented toward the drive end bearing 14. The stamped relief groove 30 here has a smaller diameter 70 than an addendum circle diameter 68 of the torque transmitting element 16 (FIGS. 3 and 4).

During operation of the hand-held power tool 10, the torque of the intermediate shaft 46 is transmitted via a torque transmitting element 72 of the intermediate shaft 46 to the torque transmitting element 16 of the drive end bearing 14 and from thence to the drive end bearing 14. The torque transmitting element 72 of the intermediate shaft 46 in this case has a transmitting contour 74 identical to the transmitting contour 18 of the torque transmitting element 16 of the drive end bearing 14. In addition, the torque transmitting element 72 of the intermediate shaft 46 is affixed to the intermediate shaft 46 for co-rotation and is situated after the torque transmitting element 16 of the drive end bearing 14 in the force flow direction 56 (FIGS. 2 and 3).

A transmitting sleeve 76 is supported on the torque transmitting element 16 of the drive end bearing 14 and on the torque transmitting element 72 of the intermediate shaft 46 and is able to slide both in the force flow direction 56 and counter to the force flow direction 56 (FIG. 2). To this end, the transmitting sleeve 76 has an inner contour, not shown in detail, which corresponds to the transmitting contours 18, 74 of the two torque transmitting elements 16, 72. During operation of the hand-held power tool 10, the torque transmission from the intermediate shaft 46 to the drive end bearing 14 can be switched on and off by means of the transmitting sleeve 76. If the transmitting sleeve 76 is covering both of the torque transmitting elements 16, 72 in a first switched position, then the torque is transmitted from the intermediate shaft 46 to the drive end bearing 14 via the two torque transmitting elements 16, 72, as shown in FIG. 2. If the operator of the hand-held power tool 10 uses an actuating element, not shown in detail, to slide the transmitting sleeve 76 counter to the force flow direction 56, then the transmitting sleeve 76 is situated in another switched position in which it covers only the torque transmitting element 16 of the drive end bearing 14, thus interrupting a torque transmission from the intermediate shaft 46 to the drive end bearing 14 or more precisely, a torque transmission between the two torque transmitting elements 16, 72.

The foregoing relates to the preferred exemplary embodiments of the invention, it being understood that other variants and embodiments thereof are possible within the spirit and scope of the invention, the latter being defined by the appended claims.

The invention claimed is:

1. A hand-held power tool, in particular a rotary hammer and/or a hammer chisel, having a transmission device equipped with a drive end bearing having a torque transmitting element extending from one end thereof and being one-piece with said drive end bearing, said torque transmitting element having a first end adjacent said one end and an opposite second end, said torque transmitting element having at least one torque transmitting contour which transmits a torque to the drive end bearing, said at least one transmitting contour of said torque transmitting element extending between said opposite second end to an intermediate location on said torque transmitting element, wherein the torque transmitting element further includes a stamped relief groove defining an annular continuous recess between said at least one transmitting contour of said torque transmitting element that extends between said intermediate location and said one end of said drive end bearing, and wherein the transmitting contour of the torque transmitting element is manufactured by an axial machining and/or a stamping process and/or a milling process.

2. The hand-held power tool as recited in claim 1, wherein the transmitting contour is situated on a radially outward-oriented surface of the torque transmitting element.

3. The hand-held power tool as recited in claim 2, wherein the transmitting contour has at least two transmitting elements that are situated spaced uniformly apart from one another in a circumference direction of the torque transmitting element.

4. The hand-held power tool as recited in claim 1, wherein the transmitting contour has at least two transmitting elements that are situated spaced uniformly apart from one another in a circumference direction of the torque transmitting element.

5. The hand-held power tool as recited in claim 4, further comprising a transmission element on which the torque transmitting element is rotatably supported.

6. The hand-held power tool as recited in claim 1, further comprising a transmission element on which the torque transmitting element is rotatably supported.

7. The hand-held power tool as recited in claim 2, further comprising a transmission element on which the torque transmitting element is rotatably supported.

* * * * *